US006092466A

United States Patent [19]

Koch et al.

[11] Patent Number: 6,092,466

[45] Date of Patent: Jul. 25, 2000

[54] METHOD FOR SELF-ADJUSTING COLOR AND CUT REGISTER CONTROL IN ROTARY PRINTING MACHINES HAVING A PLURALITY OF WEBS

[75] Inventors: Dieter Koch, Oberrohrdorf; Heinz Flamm, Villmergen, both of Switzerland

[73] Assignee: Asea Brown Boveri AG, Baden, Switzerland

[21] Appl. No.: 09/277,741

[22] Filed: Mar. 29, 1999

[30] Foreign Application Priority Data

Apr. 16, 1998 [EP] European Pat. Off. ..... 98810329

[51] Int. Cl.[7] ..... B41F 1/34

[52] U.S. Cl. ..... 101/485; 101/219; 101/248; 226/2; 226/24; 226/27; 242/410

[58] Field of Search ..... 101/216, 183, 101/219–221, 224–229, 231, 232, 248, 211, 178–181, 485; 226/1–3, 10, 24, 27–30, 40, 42, 43, 195; 242/410, 554, 554.1, 554.2, 554.5

[56] References Cited

U.S. PATENT DOCUMENTS

| | | | |
|---|---|---|---|
| Re. 32,967 | 6/1989 | St. John et al. . | |
| 2,999,295 | 9/1961 | Manning et al. | 26/54 |
| 4,264,957 | 4/1981 | Pautzke . | |
| 4,369,906 | 1/1983 | Isherwood | 226/42 |
| 4,848,630 | 7/1989 | Niestrath et al. | 226/4 |
| 5,056,431 | 10/1991 | Sainio | 101/219 |
| 5,361,960 | 11/1994 | Fokos et al. | 226/2 |
| 5,485,386 | 1/1996 | Andreasson | 364/471 |
| 5,740,054 | 4/1998 | Durr et al. . | |

FOREIGN PATENT DOCUMENTS

| | | |
|---|---|---|
| 0226166 | 6/1987 | European Pat. Off. . |
| 0452704A2 | 10/1991 | European Pat. Off. . |
| 4344896A1 | 7/1995 | Germany . |
| WO94/07692 | 4/1994 | WIPO . |

*Primary Examiner*—Kimberly Asher
*Attorney, Agent, or Firm*—Burns, Doane, Swecker & Mathis, L.L.P.

[57] ABSTRACT

A method for self-adjusting color and cut register control in rotary printing machines having individual or a plurality of webs is specified, according to which the amount of relative web stretching of the individual web sections is calculated from the operating points of the drives driving the web and the correcting variables for color and cut registers are derived from the production-dependent combination of all the stretching values.

5 Claims, 2 Drawing Sheets

METHOD FOR SELF-ADJUSTING COLOR AND CUT REGISTER CONTROL IN ROTARY PRINTING MACHINES HAVING A PLURALITY OF WEBS

BACKGROUND OF THE INVENTION

1. Field of the Invention

The invention relates to the field of printing technology, in particular to register control in web-fed rotary printing machines.

2. Discussion of Background

The invention is employed to particular advantage in shaftless rotary printing machines. A shaftless rotary printing machine with rubber blanket and plate or forme cylinders combined in pairs to form cylinder groups is described in DE 43 44 896 A1. European Patent Application Number 98101727.0, not previously published, describes a method for regulating the drive for transporting a paper web of a printing machine, said method being suitable particularly for shaftless rotary printing machines. According to this method, the regulation of the rotational speed of the elements determining the web tension is lowered or raised as a function of a load torque in accordance with a load characteristic, so that the drive simultaneously adjusts the command variables, namely the rotational speed and driving torque or web tension, and so that the leading desired value is compensated in accordance with the load characteristic.

An essential advantage of individually driven rotary printing machines is that these machines are capable of carrying out a product change while the machine is running. The method described in the abovementioned European patent application for the most part avoids the web tension changes which normally occur due to printing stations being thrown on and off, as required during a product change, and in the event of a paper type change while the machine is running. The stability thereby achieved in respect of the transport of a paper web of a printing machine is excellent.

Despite the excellent stability as regards the transport of a paper web, there is one problem which it does not solve, or only partially solves, particularly in the case of a product change or paper type change while the machine is running, namely the positioning of the color and cut registers which determines the print quality.

According to the prior art, as shown in FIG. 2, color and cut registers are influenced by independent measuring elements, in that the regulating variables recorded by the measuring elements are linked to the positioning command variables and consequently adjust the individual actuators in terms of the color register and all of the actuators together in terms of the cut register. Where divided webs are concerned, the cut register is adjusted (not illustrated) by means of additional actuators (secondary register). The disadvantage of these devices is that:

- during startup operations, the command variables are set at fixed reference values and therefore often require manual actions by the printers.
- the measuring elements react only to the stretching of the paper web.
- the measurement reaction time due to the dead times during the transport of the web as far as the measuring element, during analysis and during the transmission of data to the control amounts typically to two seconds and the quality of the actual values recorded depends on the smooth running of the web.
- the tension/stretching conditions of an entire production having a plurality of webs are considerably influenced by the mutual reaction of the webs running over the common collecting roller.

The conclusion which may be drawn is that, in the prior art, inaccuracy in register control as regards color and cut is permitted initially, before correcting action is taken on the command variables relatively slowly via additional measuring elements.

SUMMARY OF THE INVENTION

Accordingly, one object of the invention is to provide a novel method for self-adjusting register control in rotary printing machines having a plurality of webs, in which variables influencing the color and cut registers, such as, for example, a change of the paper type or of the content of the printed product while the machine is running, dry or damp paper, a different number of printing stations for each paper web, different paper lengths, etc., are recorded at the origin in all the possible operating modes of the machine and have a controlling action on the desired values for the color and cut registers. At the same time, each tension element of the paper web is advantageously operated via a regulating device according to the abovementioned European patent application which has not been previously published.

The essence of the invention is that a correcting value is calculated from the operating points, that is to say, in particular, from the current rotational speed and the torque, of the servomotors for the tension elements of the paper web and is locked onto the command variables for positioning the color and cut registers. The operating points of the servomotors react extremely quickly to changes in the paper quality, thus resulting in high dynamics along with short reaction times as regards influence exerted on the registers. Since the web length of the part sections between the tension elements of the paper webs of a current production are known, a measure of the relative paper stretching per part section can be calculated from the operating points of the drives and linked individually, in the form of a correcting variable, to the registers. Although the actual influence exerted by these correcting variables on the color and cut registers is different, the method remains fundamentally the same for both registers.

In the case of a change of the content of the printed product while the machine is running, both the web sections of the current production and those of the next production are known. In the method according to the invention, therefore, the registers can be influenced by the new web sections directly during the production change.

As compared with operation according to the prior art, striking advantages are afforded, particularly during a change in the paper type or in the content of the printed product while the machine is running, in that

- a generally constant behavior of the paper webs results from the controlled correction of all the registers.
- the color registers are preadjusted with quick reaction by virtue of the controlled influence exerted on them,
- the cut position is preadjusted with quick reaction by virtue of the controlled influence exerted on all the web tension elements determining the cut position.
- less spoilage is produced as a result of improved adherence to color and register in all phases of operation.

The printing process can therefore be controlled more effectively as a whole. Further advantageous embodiments may be gathered from the corresponding dependent claims.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings wherein.

DESCRIPTION OF THE PREFERRED EMBODIMENTS

Figure 1:
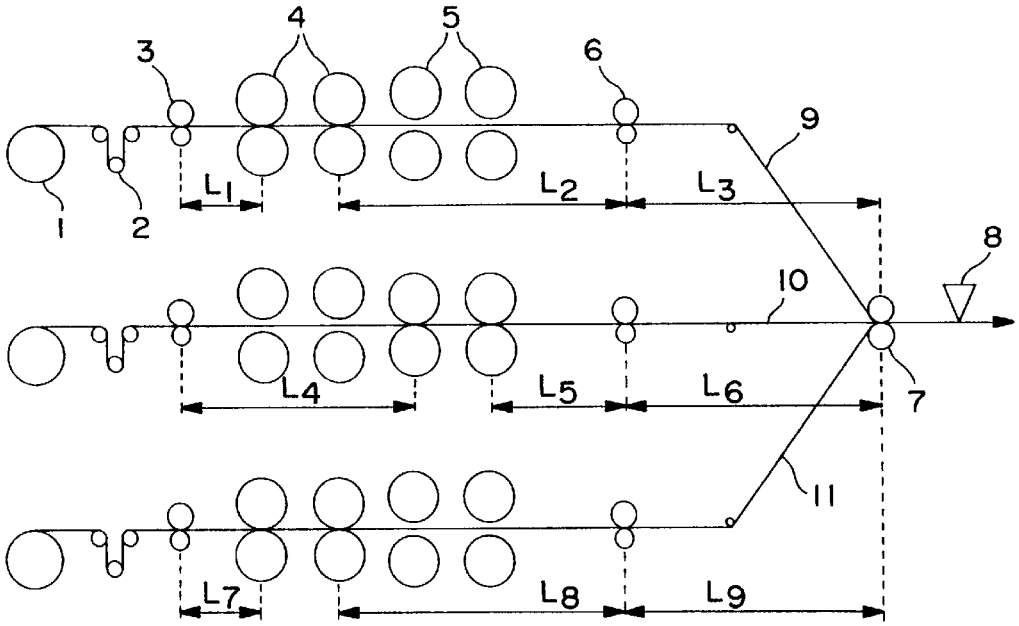
FIG. 1 shows a diagrammatic illustration of the rotary printing machine with a plurality of webs and with the machine elements advancing the web.

Referring now to the drawings, wherein like reference numerals designate identical or corresponding parts throughout the several views, FIG. 1 shows a diagrammatic illustration of the rotary printing machine with a plurality of webs and with the machine elements advancing the web. The path which the paper to be printed takes from the roll change 1 via the compensating roller 2 and the pretension assembly 3, via any desired combination of thrown-on printing units 4 and thrown-off printing units 5, via the tension roller 6 and the funnel entry tension roller 7 as far as the folding blade 8 in the folding apparatus, is designated as the paper guide or paper web. The pretension assembly 3 controls the web tension and web speed mainly within the web section L1 and thereby indirectly influences the color register accuracy of the thrown-on printing units 4. The tension element 6 controls the web tension and web speed mainly within the web section L2 and thereby indirectly influences the cut position. The funnel entry tension roller monitors the web tension and web speed mainly within the combined web sections L3, L6, L9 and thereby indirectly influences the cut position. The same, of course, applies accordingly to the remaining webs and web sections L4 to L7. The convergence of the webs at the funnel entry tension roller is not free of any reaction; here, the converging webs exert influence on one another as regards web tension and web speed.

Figure 2:
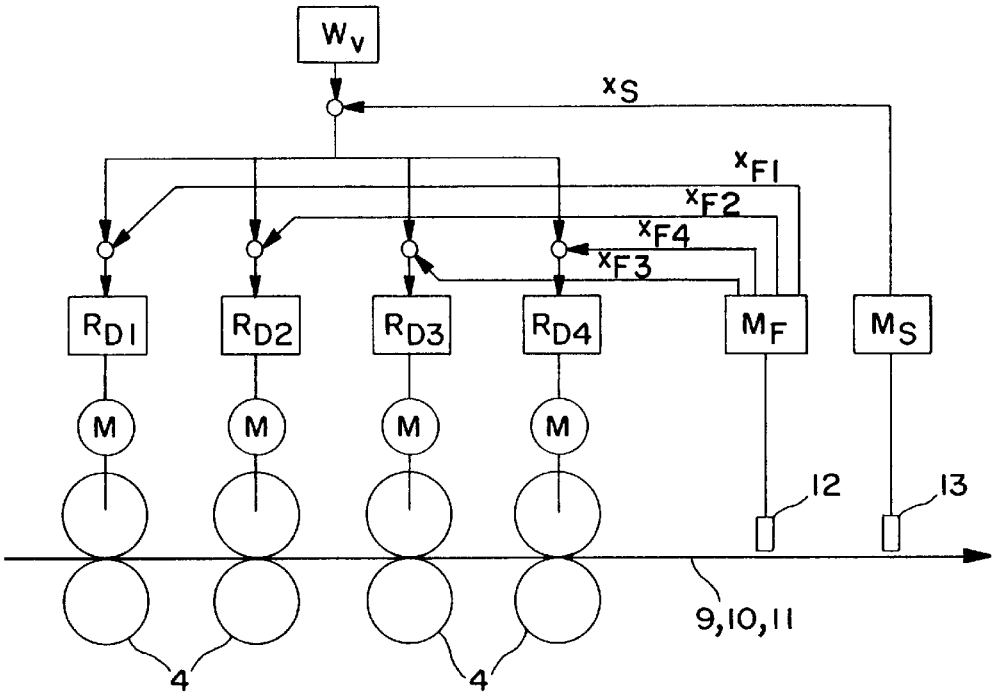
FIG. 2 PRIOR ART
FIG. 2 shows a diagrammatic illustration of the color and cut position regulation according to the prior art. In this case, only the elements on one side of the web are illustrated; the illustration applies accordingly to the rear side of the web.

FIG. 2 illustrates regulation of the color and cut registers according to the prior art. The main command variable $W_v$ determines the rotational speed and position of all the thrown-on and thrown-off printing units 4 via regulating devices $R_{D1}$, $R_{D2}$, $R_{D3}$, $R_{D4}$. The regulating devices contain individual feedbacks for position and rotational speed, these feedbacks not being illustrated in the Figure. The relative position of each printed color is recorded via measuring sensor 12 in the color register measuring system $M_F$ and is linked individually, as a regulating variable $x_{F1}$, $x_{F2}$, $x_{F3}$, $x_{F4}$, to the desired values of the individual printing units. The Figure shows only the devices on one side of the web 9, 10 or 11; the illustration applies accordingly to the rear side of the web and to all the webs. The cut position is recorded, shortly before the cut, by means of a measuring sensor 13, the signal of which is supplied to a cut register measuring system $M_S$ which determines the relative cut position of the web in relation to the printed image either from printed register marks or by evaluating the position of the printed image. The relative cut position acts as a correcting regulating variable $x_s$ for the main command variable $W_v$.

The method according to the invention for self-adjusting color and cut register control for rotary printing machines having a plurality of webs is explained in more detail below with the aid of FIG. 3. The devices in the method according to the invention are designated by KORR and KONF and the corresponding signals by k . . . For the sake of greater clarity in FIG. 3, the influences of the web rear side 9 and of the remaining webs 10, 11 are illustrated only in brief. Thus, $k_{xn}$ represents the operating points of the servomotors and $k_{yn}$ the correcting variables for the regulating devices of all the other elements involved in transporting the web.

Figure 3:
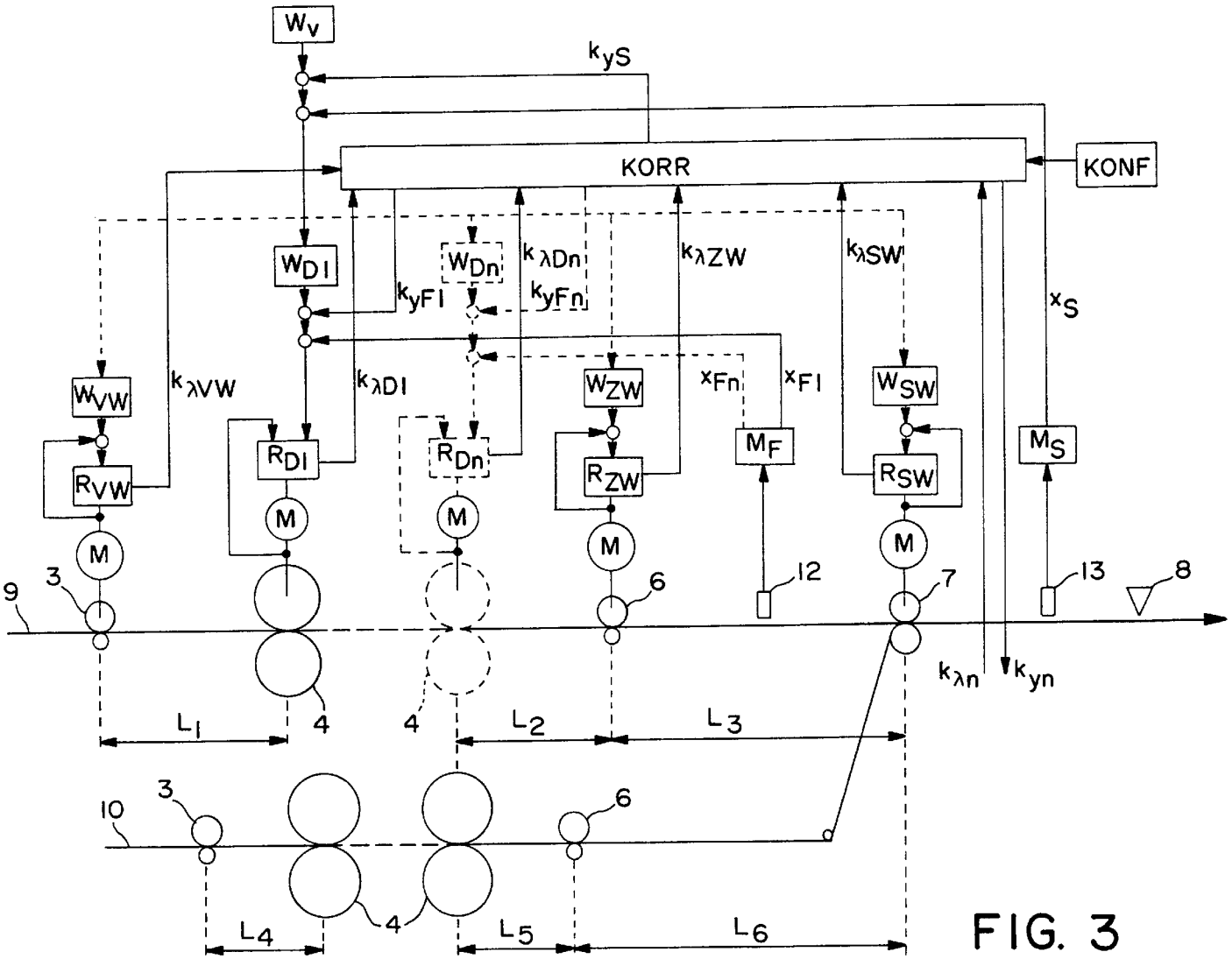
FIG. 3 shows a diagrammatic illustration of the color and cut register control by the method according to the invention. In this case, only the elements on one side of one web are illustrated; the illustration applies accordingly to the rear side of the web and to all other webs.

It is evident from FIG. 3 that the conventional color and cut register regulation, similar to FIG. 2, has been adopted; however, its use is optional and is not conditional.

The command variable $W_{VW}$ and controller $R_{VW}$ and drive M form the regulating device for the pretension assembly, the command variable $W_{Dl}$ and controller $R_{D1}$ and drive M form the regulating device for the first printing unit, the command variable $W_{Dn}$ and controller $R_{Dn}$ and drive M form the regulating device alternatively for all the remaining printing units, the command variable $W_{ZW}$ and controller $R_{ZW}$ and drive M form the regulating device for the tension roller, the command variable $W_{SW}$ and controller $R_{SW}$ and drive M form the regulating device for the funnel entry tension roller, the measuring sensor 12 and color register measuring system $M_F$ form the measuring element for the color registers, the measuring sensor 13 and cut register measuring system $M_S$ form the measuring element for the cut registers.

These conventional devices are supplemented by devices in the method according to the invention, in that the correcting variable $ky_s$ is linked as position offset for the cut register to the main command variable $W_v$ and the correcting variable $ky_{Fl} \ldots ky_{Fn}$ is linked as position offset for the color registers to the individual printing units. The correcting variables are calculated in the module KORR from the operating points of all the drives, that is to say, in particular, the current rotational speed and the torque of those drives which are involved in transporting the webs, that is to say from the drive for the pretension assembly 3, from the thrown-on printing units 4, from the tension roller 6 and from the funnel entry tension roller 7 as well as, correspondingly, from all the devices, not illustrated, for the rear side of the web and for the remaining webs 10, 11. The drives react to load torque changes by a change in the driving speed and the web tension; a new drive operating point is thus established in the rotational speed/web tension diagram. The operating points $k_{xVW}$, $k_{xDl}$, $k_{xDn}$, $k_{xZW}$ and $k_{xSW}$, recorded in this way, are illustrated in FIG. 3 explicitly for the top side of the web 9; they are recorded correspondingly for the rear side of the web and for all the remaining webs and are represented by $k_{xn}$. The web paper stretching, which is important for the register behavior, is in a ratio to the load torque according to a specific function and, together with the web section length as far as the next drive, can be calculated directly from the operating point of the servomotor. The corresponding general formula for the amount of paper stretching is:

$$\lambda = \sigma \cdot \frac{L}{E}$$

In this:

$\lambda$=Web elongation in m $\sigma$=Tensile stress of the web in dN/m=f (load torques)

L=Web section length in m

E=Modulus of elasticity in N/m=f (load torques, speeds)

The amount of paper stretching is determined in the module KORR; the web section lengths required for this purpose are known for each production and are filed in the module KONF. The proportionate influence exerted by the criterion recorded for the relative web stretching on the color and cut registers, that is to say the determination of the correcting variables $k_{yF1} \ldots k_{yFn}$, $k_{yS}$, or $k_{yn}$, likewise takes place in the module KORR on the basis of the machine configuration filed in the module KONF. This calculation of the individual correcting variables is carried out according to the general formula $$k_{ym}=f(KONF, k_{x1}, \ldots, k_{xm})$$

In this:

$k_{ym}$=$m^{th}$ correcting variable, that is to say $k_{yFl} \ldots k_{yFn}$, $k_{yS}$ or $k_{yn}$ KONF=configuration data of a production $k_{xl}$=operating point of the first drive of a production $k_{xm}$=operating point of the last drive of a production.

The variables calculated in this way are illustrated in FIG. 3 explicitly for the top side of the web 9; they are calculated accordingly for the rear side of the web and for all the remaining webs and are represented by $k_{yn}$.

When this method is applied to all the drives driving the paper web and to all the webs, conclusions as to the effective paper qualities of all the webs are obtained virtually without any delay and, consequently, correcting action can be taken on the command variables for the color and cut registers via the correcting variables $k_{yFl} \ldots k_{yFn}$, $k_{yS}$ or $k_{yn}$.

Not only the data of the machine configuration for the current production are filed in the module KONF, but also the data for the next production. Using the method according to the invention, whilst taking into account the machine configuration data for the next production, thus makes it possible that, in the event of a production change along with a changing paper type or printing station configuration, this change can simultaneously be linked in the form of a correction to the relevant command variables for the color and cut registers. In terms of reaction time, this correction is quicker by a multiple than register regulation according to the prior art. The latter serves merely to compensate any possible residual errors. A generally valid solution for rapid self-adjusting color and cut register control for all the operating situations of a printing machine is thus obtained.

Obviously, numerous modifications and variations of the present invention are possible in light of the above teachings. It is therefore to be understood that, within the scope of the appended claims, the invention may be practised otherwise than as specifically described herein.

What is claimed as new and desired to be secured by Letters Patent of the United States is:

1. A method for self-adjusting color and cut register control in rotary printing machines having individual or a plurality of paper webs, the transport of the paper web being carried out essentially by means of individual drives spaced from one another by web section lengths, wherein relative web stretching values are calculated from the instantaneous operating point ($k_{xVW}$, $k_{xD1}$, $k_{xDn}$, $k_{xZW}$, $k_{xSW}$ or $k_{xn}$) of the respective drive and the web section length as far as the next drive for each drive transporting the paper web, and wherein, by combining all the web stretching values calculated in this way, correcting variables ($k_{yF1} \ldots k_{yFn}$, $k_{ys}$ or $k_{yn}$) are calculated, in accordance with which the command variables ($W_v$, $W_{VW}$, $W_{D1} \ldots W_{Dn}$, $W_{ZW}$, $W_{SW}$) for the color and cut registers are corrected.

2. The method as claimed in claim 1, wherein the web stretching values are calculated according to the relation $$\lambda = \sigma \cdot \frac{L}{E},$$

with $\lambda$=web elongation in m; $\sigma$=tensile stress of the web; L=web section length in m; E=modulus of elasticity in N/m.

3. The method as claimed in claim 2, wherein the modulus of elasticity E is determined from the operating points of the involved drives as a function of the load torque and of the speed, and wherein the tensile stress $\sigma$ is determined as a function of the torque of the drives.

4. The method as claimed in claim 1, wherein the web section lengths for different productions are filed in a configuration data module.

5. The method as claimed in claim 4, wherein the command variables ($W_v$, $W_{VW}$, $W_{D1} \ldots W_{Dn}$, $W_{ZW}$, $W_{SW}$) are corrected proportionately, and wherein corresponding proportion factors are determined on the basis of a machine configuration filed in the configuration data module.

* * * * *